US006290336B1

(12) United States Patent
Cleland

(10) Patent No.: US 6,290,336 B1
(45) **Date of Patent: *Sep. 18, 2001**

(54) SEGMENTED RESISTOR DROP GENERATOR FOR INKJET PRINTING

(75) Inventor: Todd A. Cleland, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/669,183

(22) Filed: Sep. 25, 2000

Related U.S. Application Data

(63) Continuation of application No. 09/386,573, filed on Aug. 30, 1999, now Pat. No. 6,123,419.

(51) Int. Cl.[7] ..... B41J 2/05
(52) U.S. Cl. ..... 347/62
(58) Field of Search ..... 347/54, 56, 61, 347/62, 63, 65

(56) References Cited

U.S. PATENT DOCUMENTS

| | | | |
|---|---|---|---|
| 4,339,762 | 7/1982 | Shirato et al. | 347/62 |
| 4,458,256 | 7/1984 | Shirato et al. | 347/54 |
| 4,514,741 | 4/1985 | Meyer | 347/62 |
| 4,870,433 | 9/1989 | Campbell et al. | 347/62 |
| 4,935,752 | 6/1990 | Hawkins | 347/62 |
| 5,212,503 | 5/1993 | Saito et al. | 347/59 |
| 5,455,613 | 10/1995 | Canfield et al. | 347/65 |
| 5,475,405 | 12/1995 | Widder et al. | 347/14 |
| 5,808,640 | 9/1998 | Bhaskar et al. | 347/58 |
| 5,835,112 | 11/1998 | Whitlock et al. | 347/50 |

FOREIGN PATENT DOCUMENTS

| | | | |
|---|---|---|---|
| 0 124 312 | 4/1984 | (EP) | B41J/3/04 |
| 124312 * | 4/1984 | (EP) | B41J/3/04 |

* cited by examiner

*Primary Examiner*—John Barlow
*Assistant Examiner*—Juanita Stephens
(74) *Attorney, Agent, or Firm*—Raymond Jenski

(57) ABSTRACT

In order to overcome inefficient power dissipation in parasitic resistances and to provide economies in the power supply, a higher resistance value segmented heater resistor is employed in a thermal inkjet printhead. A production tolerance early failure mechanism is avoided with the use of a cut introduced into the conductive shorting bar coupling the segments of the heater resistor.

11 Claims, 7 Drawing Sheets

SEGMENTED RESISTOR DROP GENERATOR FOR INKJET PRINTING

CROSS REFERENCE TO RELATED APPLICATION

This is a continuation of application Ser. No. 09/386,573 filed on Aug. 30, 1999 now U.S. Pat. No. 6,123,419.

BACKGROUND OF THE INVENTION

The present invention relates generally to inkjet printing devices, and more particularly to an inkjet printhead drop generator that utilizes a high resistance heater resistor structure employing an optimized shorting bar design.

The art of inkjet printing technology is relatively well developed. Commercial products such as computer printers, graphics plotters, copiers, and facsimile machines successfully employ inkjet technology for producing hard copy printed output. The basics of the technology has been disclosed, for example, in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Inkjet devices have also been described by W. J. Lloyd and H. T. Taub in Output Hardcopy Devices (R. C. Durbeck and S. Sherr, ed., Academic Press, San Diego, 1988, chapter 13).

A thermal inkjet printer for inkjet printing typically includes one or more translationally reciprocating print cartridges in which small drops of ink are formed and ejected by a drop generator towards a medium upon which it is desired to place alphanumeric characters, graphics, or images. Such cartridges typically include a printhead having an orifice member or plate that has a plurality of small nozzles through which the ink drops are ejected. Beneath the nozzles are ink firing chambers, enclosures in which ink resides prior to ejection by an ink ejector through a nozzle. Ink is supplied to the ink firing chambers through ink channels that are in fluid communication with an ink reservoir, which may be contained in a reservoir portion of the print cartridge or in a separate ink container spaced apart from the printhead.

Ejection of an ink drop through a nozzle employed in a thermal inkjet printer is accomplished by quickly heating the volume of ink residing within the ink firing chamber with a selectively energizing electrical pulse to a heater resistor ink ejector positioned in the ink firing chamber. At the commencement of the heat energy output from the heater resistor, an ink vapor bubble nucleates at sites on the surface of the heater resistor or its protective layers. The rapid expansion of the ink vapor bubble forces the liquid ink through the nozzle. Once the electrical pulse ends and an ink drop is ejected, the ink firing chamber refills with ink from the ink channel and ink reservoir.

The electrical energy required to eject an ink drop of a given volume is referred to as "turn-on energy". The turn-on energy is a sufficient amount of energy to overcome thermal and mechanical inefficiencies of the ejection process and to form a vapor bubble having sufficient size to eject a predetermined amount of ink from the printhead nozzle. Following removal of electrical power from the heater resistor, the vapor bubble collapses in the firing chamber in a small but violent way. Components within the printhead in the vicinity of the vapor bubble collapse are susceptible to fluid mechanical stresses (cavitation) as the vapor bubble collapses, thereby allowing ink to crash into the ink firing chamber components. The heater resistor is particularly susceptible to damage from cavitation. A protective layer, comprised of one or more sublayers, is typically disposed over the resistor and adjacent structures to protect the resistor from cavitation and from chemical attack by the ink. The protective sublayer in contact with the ink is a thin hard cavitation layer that provides protection from the cavitation wear of the collapsing ink. Another sublayer, a passivation layer, is typically placed between the cavitation layer and the heater resistor and its associated structures to provide protection from chemical attack. Thermal inkjet ink is chemically reactive, and prolonged exposure of the heater resistor and its electrical interconnections to the ink will result in a chemical attack upon the heater resistor and electrical conductors. The protection sublayers, however, tend to increase the turn-on energy required for ejecting drops of a given size. Additional efforts to protect the heater resistor from cavitation and attack have included separating the heater resistor into several parts and leaving a center zone (upon which a majority of the cavitation energy concentrates in a top firing thermal inkjet firing chamber) free of resistive material.

The heater resistors of a conventional inkjet printhead comprise a thin film resistive material disposed on an oxide layer of a semiconductor substrate. Electrical conductors are patterned onto the oxide layer and provide an electrical path to and from each thin film heater resistor. Since the number of electrical conductors can become large when a large number of heater resistors are employed in a high density (high DPI - dots per inch) printhead, various multiplexing techniques have been introduced to reduce the number of conductors needed to connect the heater resistors to circuitry disposed in the printer. See, for example, U.S. Pat. No. 5,541,629 "Printhead with Reduced Interconnections to a Printer" and U.S. Pat. No. 5,134,425, "Ohmic Heating Matrix". Each electrical conductor, despite its good conductivity, imparts an undesirable amount of resistance in the path of the heater resistor. This undesirable parasitic resistance dissipates a portion of the electrical power which otherwise would be available to the heater resistor. If the heater resistance is low, the magnitude of the current drawn to nucleate the ink vapor bubble will be relatively large and the amount of energy wasted in the parasitic resistance of the electrical conductors will be significant. That is, if the ratio of resistances between that of the heater resistor and the parasitic resistance of the electrical conductors (and other components) is too small, the efficiency of the printhead suffers with the wasted energy.

The ability of a material to resist the flow of electricity is a property called resistively. Resistively is a function of the material used to make the resistor and does not depend upon he geometry of the resistor of the thickness of the resistive film used to form the resistor. Resistively is related to resistance by:

$$R=\rho L/A$$

where R=resistance (Ohms); ρ=resistively (Ohm-cm); L=length of resistor; and A=cross sectional area of resistor. For thin film resistors typically used in thermal inkjet printing applications, a property commonly known as sheet resistance ($R_{sheet}$) is commonly used in analysis and design of heater resistors. Sheet resistance is the resistively divided by the thickness of the film resistor, and resistance is related to sheet resistance by:

$$R=R_{sheet}(L/W)$$

where L=length of the resistive material and W=width of the resistive material. Thus, resistance of a thin film resistor of a given material and of a fixed film thickness is a simple calculation of length and width for rectangular and square geometries.

Most of the thermal inkjet printers available today use square heater resistors that have a resistance of 35 to 40 Ohms. If it were possible to use resistors with higher values of resistance, the energy needed to nucleate an ink vapor bubble would be transmitted to the thin film heater resistor at a higher voltage and lower current. The energy wasted in the parasitic resistances would be reduced and the power supply that provides the power to the heater resistors could be made smaller and less expensive. Realization of the higher values of resistance, however, may increase the density of current in structures associated with the heater resistors despite the overall current reduction. High current density can reduce the life of electronic circuits by creating localized elevated temperatures and by generating high electric field strengths that induce electromigration in materials. Moreover, in applications where the current is switched on and off, such as in thermal inkjet heater resistors, extreme thermal cycling produces expansion and contraction, which results in fatigue failures. Actual thin film production techniques have been shown to introduce early failures in otherwise conservatively designed thin film structures. Other than employing high cost production tolerancing processes, an economical design and high quality design of a segmented heater resistor ink ejector capable of withstanding current crowding is needed for modern thermal inkjet printing applications.

SUMMARY OF THE INVENTION

A segmented heater resistor for a thermal inkjet printhead includes a first heater resistor segment disposed adjacent a second heater resistor segment on a substrate. The first heater resistor segment has an output port and the second heater resistor segment has an input port. A conductive shorting bar, having a length dimension and a width dimension, is disposed on the substrate and electrically couples the first heater resistor segment output port to the second heater resistor segment input port. A high current density area is disposed in the shorting bar between the first heater resistor segment output port and the second heater resistor segment input port. A cut in the shorting bar is disposed adjacent to and bounds at least part of the high current density area.

DETAILED DESCRIPTION OF A PREFERRED EMBODIMENT

There are three main techniques for obtaining a higher resistance heater resistor for use in a thermal inkjet printer application. First, a thinner resistance layer can be deposited on the substrate oxide. The downside of this approach is that as the films become thinner, they become susceptible to surface defects and, the thinner the film, the more difficult it becomes to control the uniformity of the film thickness. Second, a different material having a higher innate resistively than the well understood tantalum-aluminum film could be used. The extreme environmental conditions experienced by the heater resistor as well as the need for an inexpensive, low defect, thin film process reduces the short term desirability of this approach. Third, new configurations of thin film resistor geometries can result in higher resistance heater resistors. It is from this third technique that the present invention derives.

Figure 1A:
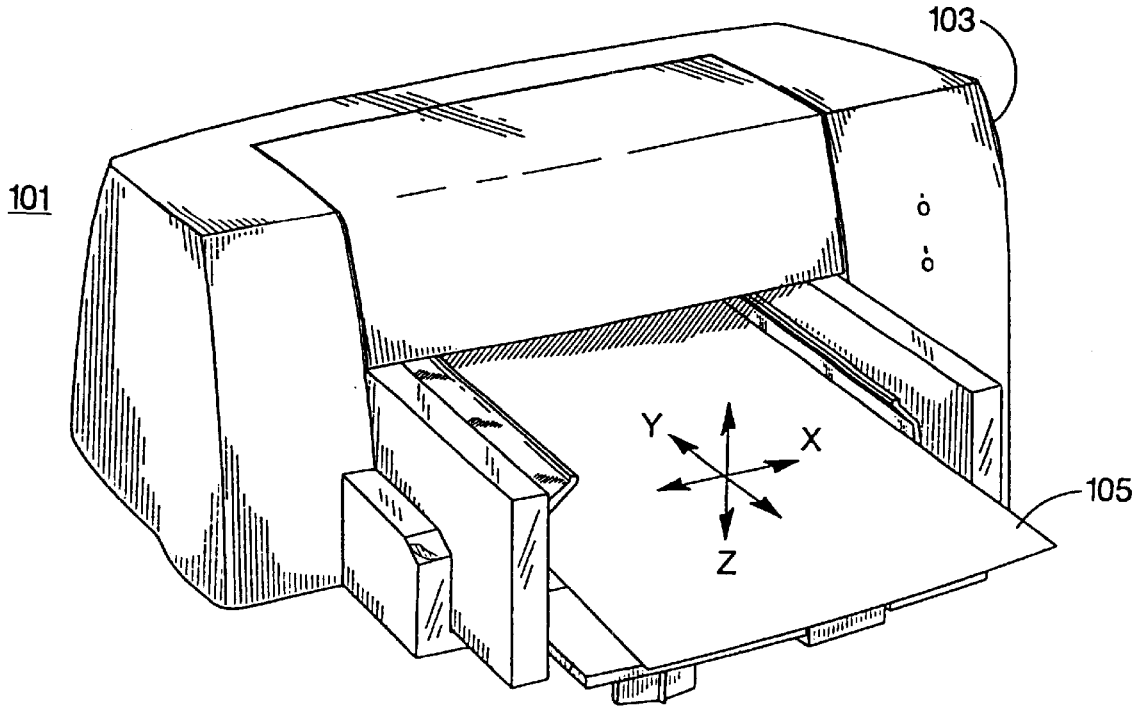
FIG. 1A is an isometric illustration of an exemplary printing apparatus which may employ the present invention.
Figure 1B:
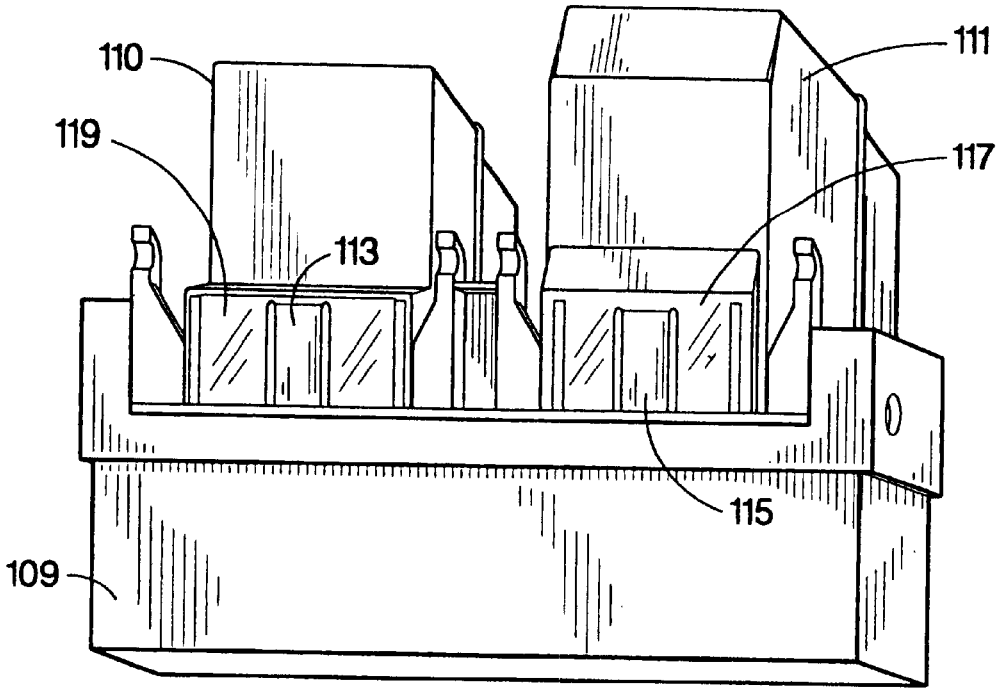
FIG. 1B is an isometric illustration of an inkjet print cartridge that may be employed in the printing apparatus of FIG. 1A.

An exemplary inkjet printing apparatus, a printer 101, that may employ the present invention is shown in outline form in isometric drawing of FIG. 1A. Printing devices such as graphics plotters, copiers, and facsimile machines may also profitably employ the present invention. A printer housing 103 contains a printing platen to which an input print medium 105, such as paper, is transported by mechanisms that are known in the art. A carriage within the printer 101 holds one or a set of individual print cartridges capable of ejecting ink drops of black or color ink. Alternative embodiments can include a semi-permanent printhead mechanism that is sporadically replenished from one or more fluidically-coupled, off-axis, ink reservoirs, or a single print cartridge having two or more colors of ink available within the print cartridge and ink ejecting nozzles designated for each color, or a single color print cartridge or print mechanism; the present invention is applicable to a printhead employed by at least these alternatives. A carriage 109, which may be employed in the present invention and mounts two print cartridges 110 and 111, is illustrated in FIG. 1B. The carriage 109 is typically mounted on a slide bar or similar mechanism within the printer and physically propelled along the slide bar, to allow the carriage 109 to be translationally reciprocated or scanned back and forth across the print medium 105. The scan axis, X, is indicated by an arrow in FIG. 1A. As the carriage 109 scans, ink drops are selectively ejected from the printheads of the set of print cartridges 110 and 111 onto the medium 105 in predetermined print swath patterns, forming images or alphanumeric characters using dot matrix manipulation. Generally, the dot matrix manipulation is determined by a user's computer (not shown) and instructions are transmitted to a microprocessor-based, electronic controller (not shown) within the printer 101. Other techniques employ a rasterization of the data in a user's computer prior to the rasterized data being sent, along with printer control commands, to the printer. This operation is under control of printer driver software resident in the user's computer. The printer interprets the commands and rasterized data to determine which drop generators to fire. The ink drop trajectory axis, Z, is indicated by the arrow. When a swath of print has been completed, the medium 105 is moved an appropriate distance along the print media axis, Y, indicated by the arrow in preparation for the printing of the next swath. This invention is also applicable to inkjet printer employing alternative means of imparting relative motion between printhead and media, such as those that have fixed printheads (such as page wide arrays) and move the media in one or more directions, those that have fixed media and move the printhead in one or more directions (such as flatbed plotters). In addition, this invention is applicable to a variety of printing systems, including large format devices, copiers, fax machines, photo printers, and the like.

The inkjet carriage 109 and print cartridges 110, 111 are shown from the −Z direction within the printer 101 in FIG. 1B. The printheads 113, 115 of each cartridge may be observed when the carriage and print cartridges are viewed from this direction. In a preferred embodiment, ink is stored in the body portion of each printhead 110, 115 and routed through internal passageways to the respective printhead. In an embodiment of the present invention which is adapted for multi-color printing, three groupings of orifices, one for each color (cyan, magenta, and yellow), is arranged on the foraminous orifice plate surface of the printhead 115. Ink is selectively expelled for each color under control of commands from the printer that are communicated to the printhead 115 through electrical connections and associated conductive traces (not shown) on a flexible polymer tape 117. In the preferred embodiment, the tape 117 is typically bent around an edge of the print cartridge as shown and secured. In a similar manner, a single color ink, black, is stored in the ink-containing portion of cartridge 110 and routed to a single grouping of orifices in printhead 113. Control signals are coupled to the printhead from the printer on conductive traces disposed on a polymer tape 119.

Figure 2:
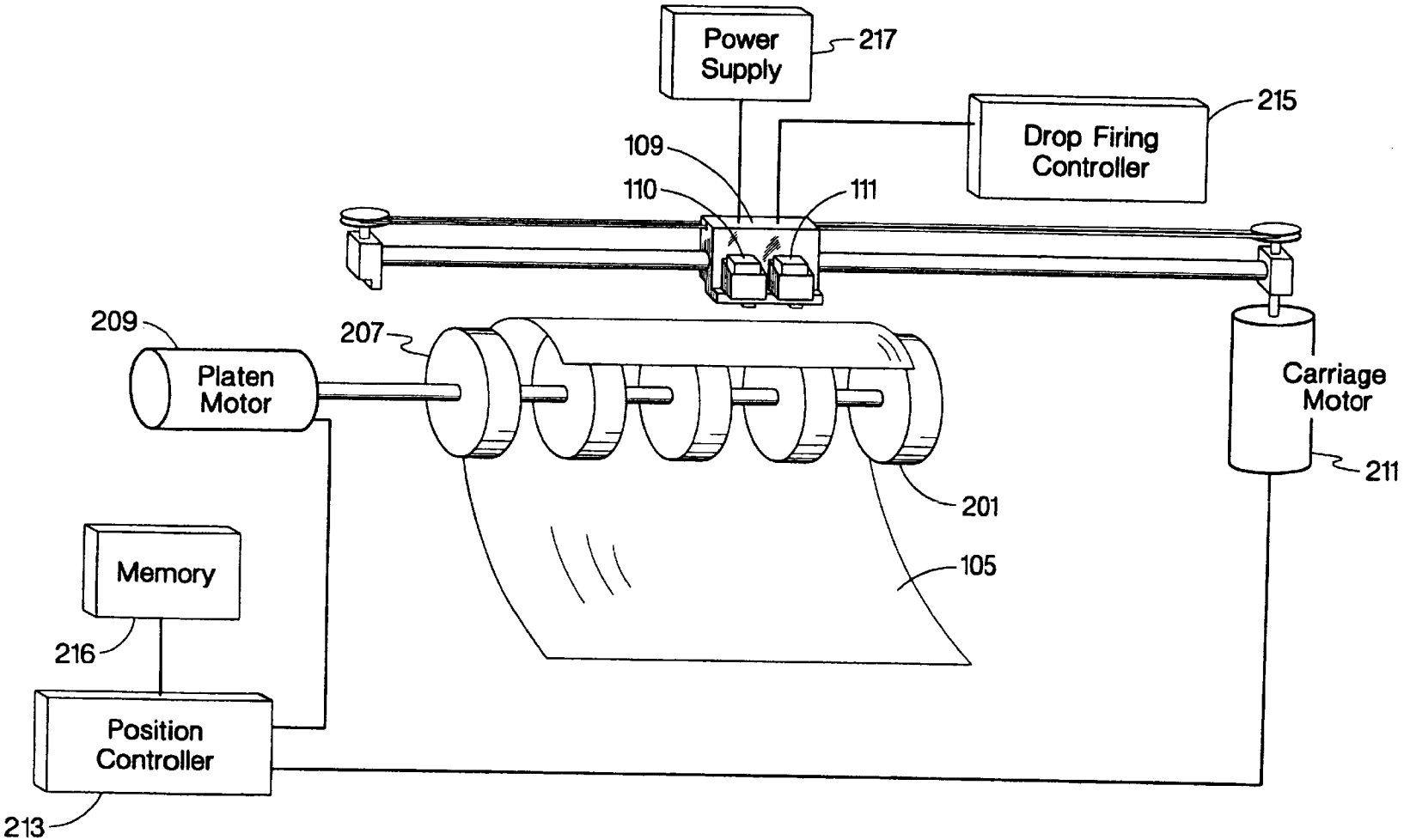
FIG. 2 is a schematic representation of the functional elements of the printing apparatus of FIG. 1A.

As can be appreciated from FIG. 2, a single medium sheet is advanced from an input tray into a printer print area beneath the printheads by a medium advancing mechanism including a roller 207, a platen motor 209, and traction devices (not shown). In a preferred embodiment, the inkjet print cartridges 110, 111 are incrementally drawn across the medium 105 on the platen by a carriage motor 211 in the ±X direction, perpendicular to the Y direction of entry of the medium. The platen motor 209 and the carriage motor 211 are typically under the control of a media and cartridge position controller 213. An example of such positioning and control apparatus may be found described in U.S. Pat. No. 5,070,410 "Apparatus and Method Using a Combined Read/Write Head for Processing and Storing Read Signals and for Providing Firing Signals to Thermally Actuated Ink Ejection Elements". Thus, the medium 105 is positioned in a location so that the print cartridges 110 and 111 may eject drops of ink to place dots on the medium as required by the data that is input to a drop firing controller 215 and power supply 217 of the printer. These dots of ink are formed from the ink drops expelled from selected orifices in the printhead in a band parallel to the scan direction as the print cartridges 110 and 111 are translated across the medium by the carriage motor 211. When the print cartridges 110 and 111 reach the end of their travel at an end of a print swath on the medium 105, the medium is conventionally incrementally advanced by the position controller 213 and the platen motor 209. Once the print cartridges have reached the end of their traverse in the X direction on the slide bar, they are either returned back along the support mechanism while continuing to print or returned without printing. The medium may be advanced by an incremental amount equivalent to the width of the ink ejecting portion of the printhead or some fraction thereof related to the spacing between the nozzles. Control of the medium, positioning of the print cartridge, and selection of the correct ink ejectors for creation of an ink image or character is determined by the position controller 213. The controller may be implemented in a conventional electronic hardware configuration and provided operating instructions from conventional memory 216. Once printing of the medium is complete, the medium is ejected into an output tray of the printer for user removal.

Figure 3:
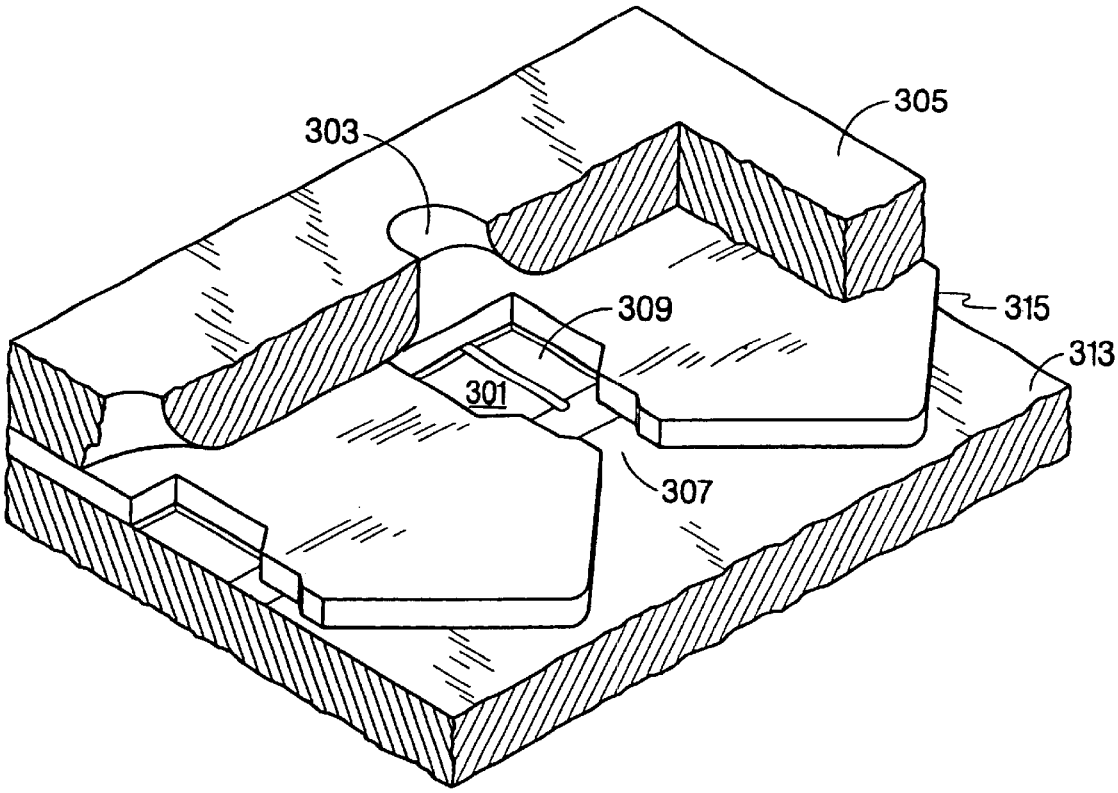
FIG. 3 is a magnified isometric cross section of a drop generator which may be employed in the printhead of the print cartridges of FIG. 1B.

A single example of an ink drop generator found within a printhead is illustrated in the magnified isometric cross section of FIG. 3. As depicted, the drop generator comprises a nozzle, a firing chamber, and an ink ejector. Alternative embodiments of a drop generator employ more than one coordinated nozzle, firing chamber, and/or ink ejectors. The drop generator is fluidically coupled to a source of ink.

In FIG. 3, the preferred embodiment of an ink firing chamber 301 is shown in correspondence with a nozzle 303 and a segmented heater resistor 309. Many independent nozzles are typically arranged in a predetermined pattern on the orifice plate 216 so that the ink that is expelled from selected nozzles creates a defined character or image of print on the medium. Generally, the medium is maintained in a position which is parallel to the plane of the external surface of the orifice plate. The heater resistors are selected for activation by the microprocessor and associated circuitry in the printer in a pattern related to the data presented to the printer by the computer so that ink which is expelled from selected nozzles creates a defined character or image of print on the medium. Ink is supplied to the firing chamber 301 via opening 307 to replenish ink that has been expelled from orifice 303 following the creation of an ink vapor bubble by heat energy released from the segmented heater resistor 309. The ink firing chamber 301 is bounded by walls created by: the orifice plate 216, a layered semiconductor substrate 313, and barrier layer 315. In a preferred embodiment, fluid ink stored in a reservoir of the cartridge housing 212 flows by capillary force to fill the firing chamber 301.

Figure 4:
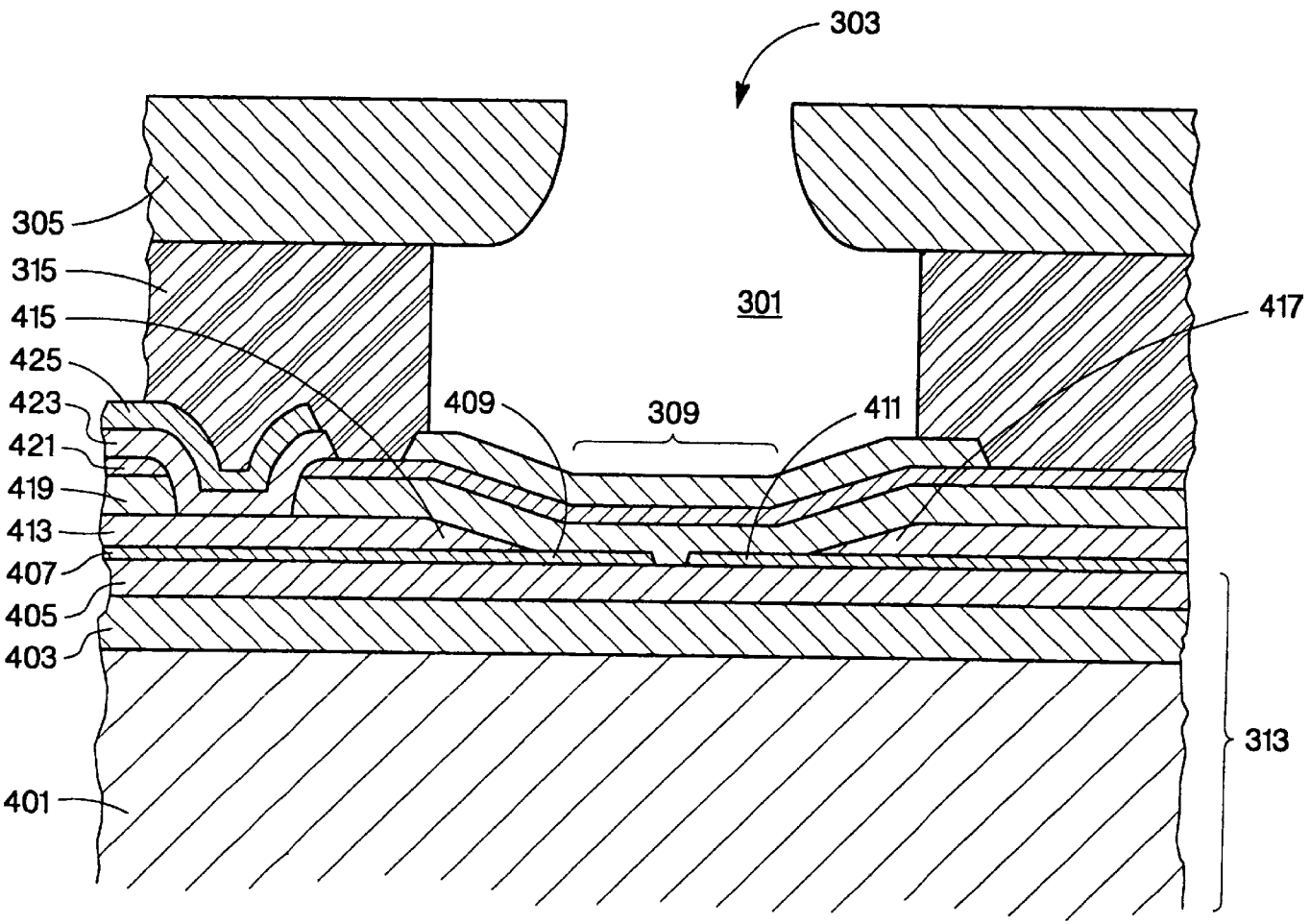
FIG. 4 is a cross sectional elevation view of the drop generator of FIG. 3.

In FIG. 4, a cross section of the firing chamber 301 and the associated structures are shown. The substrate 313 comprises, in the preferred embodiment, a semiconductor base 401 of silicon, treated using either thermal oxidation or vapor deposition techniques to form a thin layer 403 of silicon dioxide and a thin layer 405 of phospho-silicate glass (PSG) thereon. The silicon dioxide and PSG forms an electrically insulating layer approximately 17000 Angstroms thick upon which a subsequent discontinuous layer 407 of tantalum-aluminum (TaAl) resistive material is deposited. The tantalum-aluminum layer is deposited to a thickness of approximately 900 Angstroms to yield a resistively of approximately 30 Ohms per square. In a preferred embodiment, the resistive layer is conventionally deposited using a magnetron sputtering technique and then masked and etched to create discontinuous and electrically independent areas of resistive material such as areas 409 and 411. Next, a layer of aluminum-silicon-copper (ALSiCu) alloy conductor is conventionally magnetron sputter deposited to a thickness of approximately 5000 Angstroms atop the tantalum aluminum layer areas 409, 411 and etched to provide discontinuous independent electrical conductors (such as conductors 415 and 417) and interconnect areas. To provide protection for the heater resistors and the connecting conductors, a composite layer of material is deposited over the upper surface of the conductor layer and resistor layer. A dual layer of passivating materials includes a first layer 419 of silicon nitride approximately 2500 Angstroms thick which is covered by a second layer 421 of inert silicon carbide approximately 1200 Angstroms thick. This passivation layer (419, 421) provides both good adherence to the underlying materials and good protection against ink corrosion. It also provides electrical insulation. An area over the heater resistor 309 and its associated electrical connection is subsequently masked and a cavitation layer 423 of tantalum approximately 3000 Angstroms thick is conventionally sputter deposited. A gold layer 425 may be selectively added to the cavitation layer 423 in areas where electrical interconnection to an interconnection material is desired. An example of semiconductor processing for thermal inkjet applications may be found in U.S. Pat. No. 4,862,197, "Process for Manufacturing Thermal Inkjet Printhead and Integrated Circuit (IC) Structures Produced Thereby." An alternative thermal inkjet semiconductor process may be found in U.S. Pat. No. 5,883,650, Thin-Film Printhead Device for an Ink-Jet Printer."

In a preferred embodiment, the sides of the firing chamber 301 and the ink feed channel are defined by a polymer barrier layer 315. This barrier layer is preferably made of an organic polymer plastic that is substantially inert to the corrosive action of ink and is conventionally deposited upon substrate 313 and its various protective layers. To realize the desired structure, the barrier layer is subsequently photolithographically defined into desired shapes and then etched. Typically the barrier layer 315 has a thickness of about 15 micrometers after the printhead is assembled with the orifice plate 216.

The orifice plate 305 is secured to the substrate 313 by the barrier layer 315. In some print cartridges the orifice plate 305 is constructed of nickel with plating of gold to resist the corrosive effects of the ink. In other print cartridges, the orifice plate is formed of a polyamide material that can be used as a common electrical interconnect structure. In an alternative embodiment, the orifice plate and barrier layer is integrally formed on the substrate.

Figure 5:
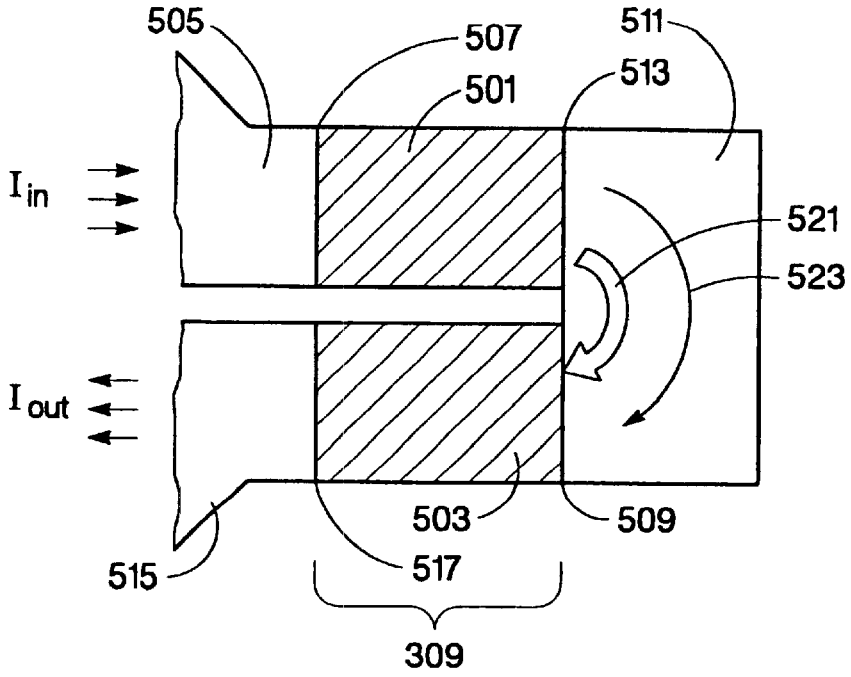
FIG. 5 is a plan view of a segmented heater employing a shorting bar.

In a preferred embodiment of the present invention, a heater resistor having a higher value of resistance is employed to overcome the problems stated above, in particular the problems of undesired energy dissipation in the parasitic resistance and of the necessity of having a high current capacity in the power supply. Here, the implementation of a higher value resistance heater resistor is that of revising the geometry of the heater resistor, specifically that of providing two segments having a greater length than width. Since it is preferred to have the heater resistor 309 located in one compact spot for optimum vapor bubble nucleation in a top-shooting (ink drop ejection perpendicular to the plane of the heater resistor) printhead, the resistor segments are disposed long side to long side as shown in FIG. 5. As shown, heater resistor segment 501 is disposed with one of its long sides essentially parallel to the long side of heater resistor segment 503. Electrical current $I_{in}$ is input via conductor 505 to an input port 507 of the resistor segment 501 disposed at one of the short sides (width) edges of resistor segment 501, The electrical current, in the preferred embodiment, is coupled to the input port 509 of the resistor segment 503 disposed at one of the short side (width) edges of resistor segment 503 by a coupling device that has been termed a "shorting bar" 511. The shorting bar is a portion of conductor film disposed between the output port 513 of heater resistor segment 501 and the input port 509 of heater resistor segment 503. The electrical current $I_{out}$ is returned to the power supply via conductor 515 connected to the output port 517 of heater resistor segment 503. As shown, with no additional electrical current sources or sinks, $I_{in}=I_{out}$. The output ports 513 and 517 of heater resistor segments 501 and 503, respectively, are disposed at the opposite short side (width) edges of the heater resistor segments from the input ports.

By placing the two resistor segments in a compact area, it is necessary for the electric current to change direction by way of the coupling device or shorting bar portion 511. Because the path of the electrons comprising the electric current is shorter between the two proximate comers of the heater resistor segments (causing the parasitic resistance of the shorter path to be less than the longer path), more of the electric current flows in this shorter path, illustrated by arrow 521 in FIG. 5, than any other path, illustrated by arrow 523. This concentration of current has been termed "current crowding". High current density produced by such current crowding will reduce the life of electronic circuits because it creates locally elevated temperatures and creates high electric field strengths that induce electromigration. In applications where the electric current is cycled on and off, such as in a thermal inkjet printhead, the rapid thermal variation causes expansion and contraction of the printhead substrate and the thin film layers disposed thereon. In areas having differential thermal expansion and contraction amounts because of the differences in thermal expansion rates of different materials, such as at the junction of a heater resistor segment and the conductor shorting bar, material fatigue stresses will cause an early failure.

With careful attention to design tolerances and material selection, lifetimes of the segmented resistor-shorting bar configuration will survive the useful lifetime of the print cartridge. It has been found, however, that thin film deposition alignment tolerances and the slope of the etched conductive metal in the direction normal to the substrate surface can result in the shorting bar being placed not only at the ports of the heater resistor segments but also between the long sides of the heater resistor segments. An exaggerated representation of this condition is depicted in FIG. 6.

A portion 601 of the shorting bar 511 has been undesirably deposited between the long dimensions of heater resistor segments 501 and 503 as a result of a standard alignment tolerance extreme. As a consequence, a portion of current, $I_2$, of the current, $I_{in}$, input to the heater resistor 309 ink ejector flows through the shorting bar portion 601 rather than out of the heater resistor segment 501 output port (as illustrated by current $I_1$). The path through shorting bar portion 601 not only may be a shorter path through conductive material (and therefore present less parasitic resistance) but, more detrimentally, will be a shorter path through the resistive material of heater resistor segment 501 (and heater resistor segment 503). The shorter heater resistor path also yields a lower resistance and therefore conducts more current.

Figure 7:
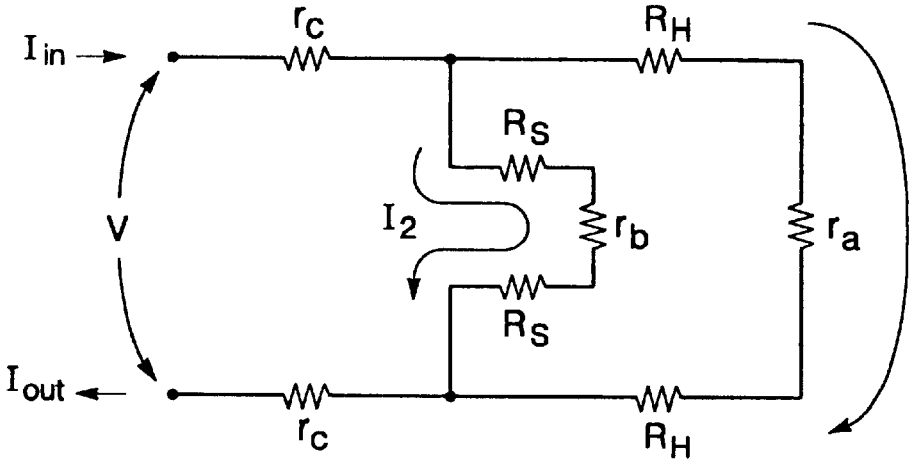
FIG. 7 is an electrical schematic diagram of the segmented heater resistor depicted in FIG. 5.
Figure 6:
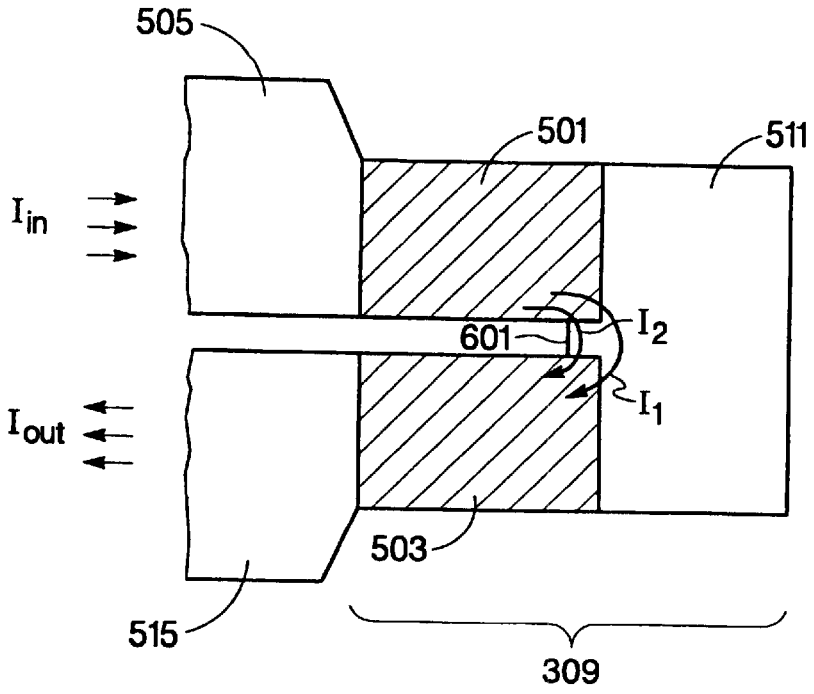
FIG. 6 is a plan view of a segmented heater resistor illustrating a shorting bar deposited on the substrate with an extreme build-up of fabrication tolerances.

Viewed another way, the schematic diagram of FIG. 7 represents the electrical model of the two selected currents of FIG. 6. The input current $I_{in}$ experiences the parasitic resistance, $r_C$, of the conductor 505 before being applied to the heater resistor segment 501. The current path through the shorting bar portion 601 encounters the resistance of the short path through heater resistor segment 501, $R_S$, and heater resistor segment 503, $R_S$, as well as the short path shorting bar portion parasitic resistance, $r_b$, before the parasitic resistance, $r_C$, of conductor 515. The desired current, $I_1$, path through the heater resistor segments 501 and 503 encounters the desired resistance, RH, of each heater resistor segment and the parasitic resistance, $r_a$, of the shorting bar conductor. (It is recognized that current through the shorting bar can and will take a multiplicity of paths through the shorting bar, and $I_1$ represents only one of such paths. The most likely path, the path of least parasitic resistance, is typically the shortest path between the output port of the heater resistor segment 501 and the input port of the heater resistor segment 503). Because of the shorter path through the heater resistor segments contacted by the shorting bar portion 601:

$$R_S<R_H,$$

and because of the likely shorter path through the shorting bar portion 601:

$$r_b \leqq r_a.$$

Since:

$$2R_S+r_b<2R_H+r_a,$$

for any given $I_{in}$:

$$_2>I_1.$$

Thus the greatest current and the highest current crowding is expected to be through the shorting bar portion 601. The highest rate of failures will occur around the shorting bar portion 601 and the lifetime of the heater resistor will be unacceptably diminished.

Figure 8:
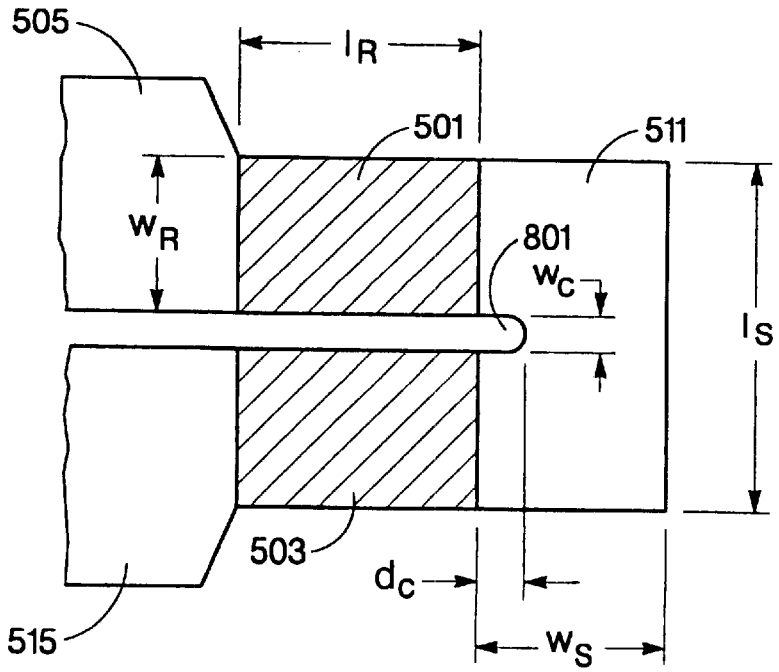
FIG. 8 is a plan view of an embodiment of a segmented heater resistor and a cut disposed in the shorting bar.

In order to overcome this result, a cut or discontinuity is introduced into the shorting bar such that, under the processing variations of a controlled thin film production environment, a short path shorting bar portion (like portion 601) will not be created. Such a cut, notch 801, is illustrated in the long dimension of shorting bar 511 of FIG. 8. In the preferred embodiment, this cut is created during the conventional metal conductor deposition, masking, and etching steps. As depicted in FIG. 8, the conductive film 511 couples the resistors 501 and 503 in series by connecting together end portions of the segmented resistors 501 and 503. The notch 801 disrupts an otherwise (when viewed from above as in FIG. 8) minimum length current pathway from the end portion of resistor 501 to the end portion of resistor 503 to reduce current crowding that would occur in the portion of the conductive film closest to and connecting to the end portions. In the preferred embodiment, this results in a generally U-shaped current flow path (when viewed from above as in FIG. 8) from resistor 501, through the thin film conductor 511, and to resistor 503.

While a perfectly aligned, non-cut, shorting bar is the best solution to coupling the two heater resistor segments, this solution cannot be reliably achieved in a real production environment. The cut in the shorting bar provide a high-yield solution. The minimum width of the shorting bar should be no less than 10 $\mu$m for thin film conductor deposition thicknesses of approximately 5000 Angstroms. The minimum width of the shorting bar varies in proportion with the deposition thickness. In the preferred embodiment, where the resistance of each segmented heater resistor ink ejector is nominally 140 Ohms and the electrical power supply voltage is approximately 11 Volts, the plan view design dimensions of the heater resistors of FIG. 8 include a heater resistor segment length, $1_R$, ranging between 20.5 $\mu$m and 24.0 $\mu$m and width, $w_R$, ranging between 9.0 $\mu$m and 11.0 $\mu$m. The shorting bar includes a length, $l_S$, of approximately 20.51 $\mu$m and a width, $w_S$, of approximately 20 $\mu$m. The design center value for the shorting bar cut is for a notch of depth, $d_C$, ranging between 2.2 $\mu$m and 4.2 $\mu$m and a notch width, $w_C$, ranging between 1.5 $\mu$m and 5.0 $\mu$m. The cut shape for the preferred embodiment was determined to be a rounded, or "U"-shaped, notch to avoid sharp discontinuities that would increase current crowding at points of small radius. Nevertheless, other cut shapes can be employed at the designer's choice, to obtain other performance advantages.

Accordingly, a segmented heater resistor for an inkjet drop generator has been shown to yield a desirably higher resistance value. Early lifetime failures due to current crowding effects in practical shorting bars have been overcome with a cut introduced at areas of high current density in the shorting bar.

I claim:

1. A thermal inkjet printhead comprising:

a printhead substrate; and an ink drop generator including a nozzle, a firing chamber arranged in correspondence with the nozzle, and an ink ejector, the ink ejector including a generally planar thin film segmented heater resistor fabricated on the substrate such that ink drop ejection from the nozzle is transverse to a plane of the heater resistor, the segmented heater resistor comprising:

a first heater resistor segment disposed adjacent a second heater resistor segment on said substrate, said first heater resistor segment having an output port and said second heater resistor having an input port;

a conductive shorting bar, comprising a side edge having a length dimension and an end edge having a width dimension, disposed on said substrate, and electrically coupling said first heater resistor segment output port to said second heater resistor segment input port with, a high current density area disposed in said shorting bar between said first heater resistor segment output port and said second heater resistor segment input port; and a notch in said side edge of said shorting bar disposed adjacent to and bounding at least part of said high current density area, said notch having a nominal depth dimension which provides high-yield fabrication of the thin film resistor without creating a short path shorting bar portion between the first heater resistor segment and the second heater resistor segment.

2. A printhead in accordance with claim 1 wherein said notch provides a portion of said shorting bar with a reduced width dimension relative to said width dimension.

3. A printhead in accordance with claim 2 wherein said width dimension is approximately 20 $\mu$m and said reduced width dimension ranges between 18.5 $\mu$m and 15 $\mu$m.

4. A printhead in accordance with claim 2 wherein said reduced width dimension is not less than 10 $\mu$m.

5. An inkjet print cartridge comprising the printhead of claim 1.

6. A printhead according to claim 1, wherein said notch has a rounded shape to avoid sharp discontinuities that would increase current crowding at points of small radius.

7. A printhead according to claim 1, wherein said depth dimension is in a range between 2.2 $\mu$m and 4.2 $\mu$m.

8. A printhead according to claim 7, wherein the notch has a width dimension in the range between 1.5 $\mu$m and 5.0 $\mu$m.

9. A thermal inkjet printhead, comprising:

a printhead substrate;

a nozzle;

a firing chamber arranged in correspondence with the nozzle;

an ink ejector including a generally planar thin film segmented heater resistor fabricated on the substrate such that ink drop ejection from the nozzle is transverse to a plane of the heater resistor, the segmented heater resistor comprising:

a first heater resistor segment and a second heater resistor segment each said first heater resistor segment and said second heater resistor segment having an end portion;

a thin film conductor segment that electrically couples said first heater resistor end portion to said second heater resistor end portion, said thin film conductor segment having a discontinuity that disrupts a minimum length current pathway through said thin film conductor segment between said first heater resistor end portion and said second heater resistor end portion to reduce current crowding that would otherwise occur between said end portions, said discontinuity having a nominal depth dimension which provides high-yield fabrication of the thin film resistor without creating a short path shorting bar portion between the first heater resistor segment and the second heater resistor segment.

10. The printhead in accordance with claim 9, wherein said discontinuity further comprises a notch in said thin film conductor segment that joins said first heater of said end portion to said second heater end portion.

11. A printhead according to claim 10, wherein said notch is U-shaped to avoid sharp discontinuities that would increase current crowding at points of small radius.

* * * * *